United States Patent [19]

Schweinfurter

[11] 4,408,952

[45] Oct. 11, 1983

[54] LATERAL CHANNEL PUMP

[76] Inventor: Friedrich Schweinfurter, Bergstr. 6, D-8541 Rottenbach, Fed. Rep. of Germany

[21] Appl. No.: 252,832

[22] Filed: Apr. 10, 1981

[30] Foreign Application Priority Data

Apr. 15, 1980 [DE] Fed. Rep. of Germany ..... 3014452

[51] Int. Cl.[3] ..... F04D 5/00

[52] U.S. Cl. ..... 415/53 T; 415/213 T; 416/223 R; 416/235

[58] Field of Search ..... 415/11, 52, 53 R, 56, 415/59, 87, 199.1, 53 T, 219 C, 73, 219 T

[56] References Cited

U.S. PATENT DOCUMENTS

| | | | |
|---|---|---|---|
| 1,817,169 | 8/1931 | Schwitzer et al. | 415/219 C |
| 1,865,504 | 7/1932 | Bird | 415/213 T |
| 1,976,896 | 10/1934 | Siemen et al. | 415/213 T X |
| 2,042,499 | 6/1936 | Brady | 415/53 T X |
| 2,321,810 | 6/1943 | Gurley | 415/87 |
| 2,413,461 | 12/1946 | Mann | 415/53 R X |
| 2,842,062 | 8/1958 | Wright | 415/11 |
| 3,202,399 | 8/1965 | Bär | 415/87 |
| 3,487,784 | 1/1970 | Rafferty et al. | 415/199.1 X |
| 3,560,104 | 2/1971 | Neale | 415/87 X |
| 3,721,505 | 3/1973 | Garnett | 415/53 T |
| 3,804,547 | 4/1974 | Hagemann | 415/53 T |
| 3,881,839 | 5/1975 | MacManus | 415/53 T |
| 4,325,672 | 4/1982 | Sixsmith et al. | 415/53 T |

FOREIGN PATENT DOCUMENTS

| | | | |
|---|---|---|---|
| 499308 | 3/1951 | Belgium | 415/52 |
| 698485 | 11/1940 | Fed. Rep. of Germany | 415/213 T |
| 225631 | 5/1943 | Fed. Rep. of Germany | 415/213 T |
| 747947 | 10/1944 | Fed. Rep. of Germany | 415/53 T |
| 879452 | 6/1953 | Fed. Rep. of Germany | 415/213 T |
| 957097 | 1/1957 | Fed. Rep. of Germany | 415/213 T |
| 1224149 | 9/1966 | Fed. Rep. of Germany | 415/213 T |
| 1934168 | 1/1971 | Fed. Rep. of Germany | 415/213 T |
| 59262 | 5/1954 | France | 415/52 |
| 1331429 | 5/1963 | France | 415/213 T |
| 52-5003 | 1/1977 | Japan | 415/53 T |
| 52973 | 7/1942 | Netherlands | 415/213 T |
| 898257 | 6/1962 | United Kingdom | 415/219 C |
| 2069621 | 8/1981 | United Kingdom | 415/53 T |
| 723223 | 4/1980 | U.S.S.R. | 415/213 T |

*Primary Examiner*—Philip R. Coe
*Assistant Examiner*—Frankie L. Stinson
*Attorney, Agent, or Firm*—Bacon & Thomas

[57] ABSTRACT

In a lateral channel pump, the rotor blade compartments of a ring of blades in the rotor alternate in length, toward the center of the rotor, between long and short rotor blade compartments. The associated lateral channel has an outer contour concentric with the center of the rotor and an inner contour which tapers helically towards the outlet port. At the inlet point of the lateral channel, a partial circulating current is separated from the main circulating current as a result of the longer blade compartments. The partial current, due to its higher speed, causes the main current to circulate more rapidly between the rotor blade compartment and the lateral channel. As a result, the main current is accelerated and a higher level of efficiency is obtained.

8 Claims, 20 Drawing Figures

LATERAL CHANNEL PUMP

Figure 1:
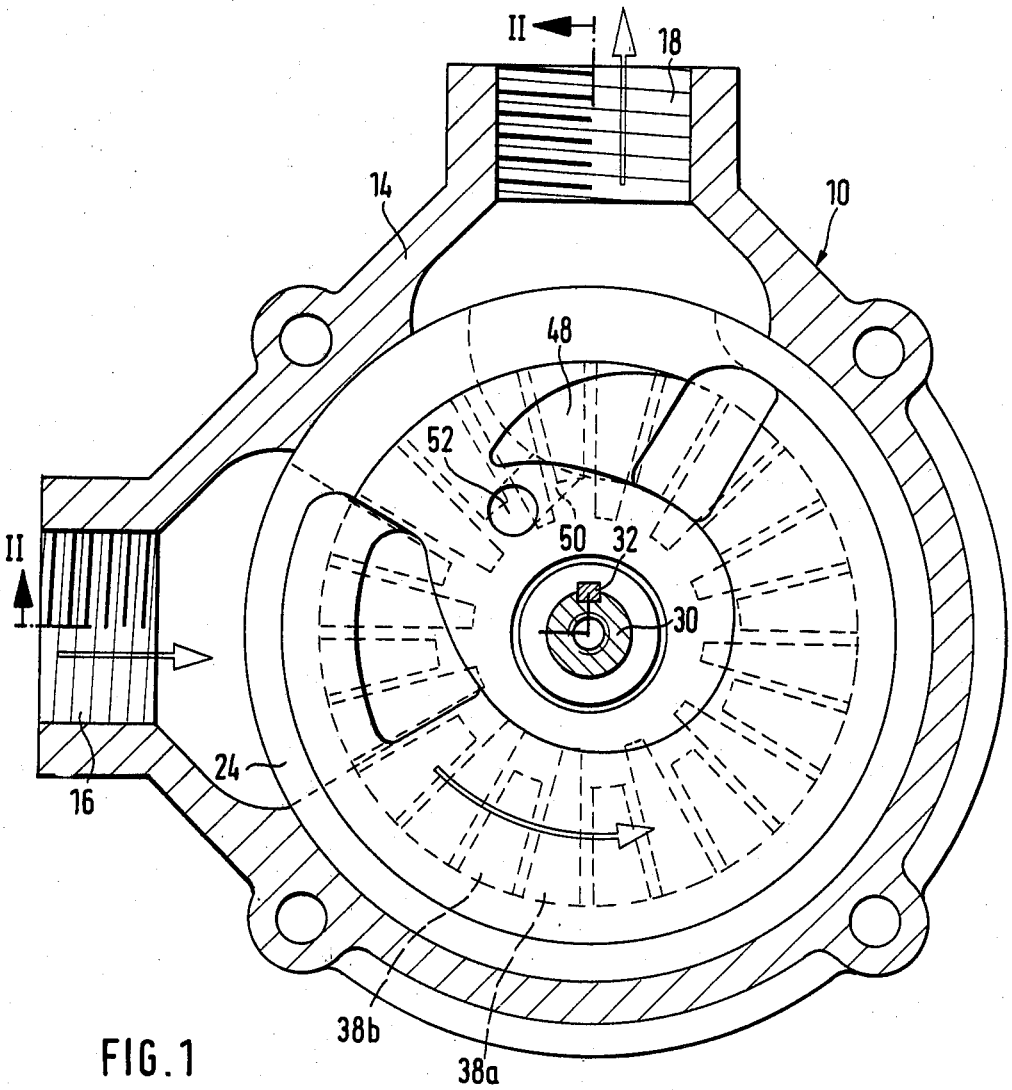

The invention relates to a lateral channel pump, comprising a housing with a shaft sealed therein and a rotor secured thereto and a flow channel which starts from an intake port in the housing and leads to an outlet port in the housing via at least one lateral channel formed therein and via corresponding rotor blade compartments in the rotor.

In this special construction of a rotary pump, the flow medium passing through the intake port into the rotor blade compartments of the rotating rotor and into the lateral channel is carried along for almost an entire revolution, the centrifugal force forming a circulating flow between the rotor compartments and the lateral channel. Energy is transmitted by the exchange of momentum from the circulating current with a higher energy level to the volume current with a lower energy level.

In the lateral channel pumps known hitherto, the blade compartments of the rotor which are important for the transmission of energy have always been of the same length and had a constant cross section for the lateral channel, apart from any deviations caused by the flow, which are restricted to the intake and outlet regions. These known constructions give only a low degree of efficiency and are therefore limited to relatively small volume currents.

Special constructions are known (cf. German patent application H 14218 Ia/59b), wherein the cross section of the lateral channel may be varied in the circumferential direction, for the purpose of regulating the performance or throughput, disregarding the energy transmission speed and efficiency. Lateral channel pumps are also known (German Pat. No. 966 487) wherein the cross section of the lateral channel begins at zero at the inlet point and increases radially towards the outlet point so as to emerge from the housing tangentially. Again, the energy transmission rate and efficiency are disregarded here. Nor do these special constructions take account of the flow processes which, as is well known, impose narrow limits on the design of lateral channel pumps, particularly on the design of the lateral channel.

The aim of the invention is to develop a lateral channel pump with a better lateral channel effect so as to achieve a higher energy transmission rate and greater efficiency.

According to the invention, this aim is achieved by the fact that the rotor blade compartments of a ring of blades in the rotor alternate in length, towards the centre of the rotor, between long and short rotor blade compartments, and by the fact that the associated lateral channel, having an outer contour which is concentric with the centre of the rotor, has an inner contour tapering helically towards the outlet port, whilst the spacing of this inner contour from the shaft, at the intake port, corresponds to the spacing of a long rotor blade compartment from the shaft and, at the outlet port, corresponds to the spacing of a short rotor blade compartment from the shaft.

Preferably, the inner contour tapers in the manner of an Archimedean screw. It may also advantageously taper in a logarithmic spiral.

The construction according to the invention has the advantage that the moderate transmission of energy from the rotor blade compartments to the volume current is substantially improved by the fact that, at the inlet point at the lateral channel, as a result of the presence of the longer blade compartments, a partial circulating current is separated from the main circulating current forming there, and this partial current, by its higher speed, causes the main current to circulate more rapidly between the rotor blade compartments and lateral channel. As a result, the main circulating current, formed primarily by the shorter rotor blade compartments, and flowing in a three-dimensional helical or spiral configuration over the entire length of the lateral channel, is increasingly accelerated, leading to substantially more frequent re-entries into the rotor blade compartments, coupled with a higher energy transmission rate and a higher level of efficiency. The lateral channel which is broader at the start allows the longer rotor blade compartment to become fully affected, and then, as it becomes narrower towards the end of the lateral channel, it gradually covers the compartment until it is the same length as the shorter rotor blade compartments, so that the partial circulating current with its consequently reduced amplitude loses relative velocity to the main circulating current and then merges into this main current entirely as it reaches the same speed of circulation.

As a further advantageous feature of the invention, the rotor may consist of rotor stages or individual discs arranged axially or radially to form multi-stage constructions with correspondingly associated lateral channels.

Figure 2:
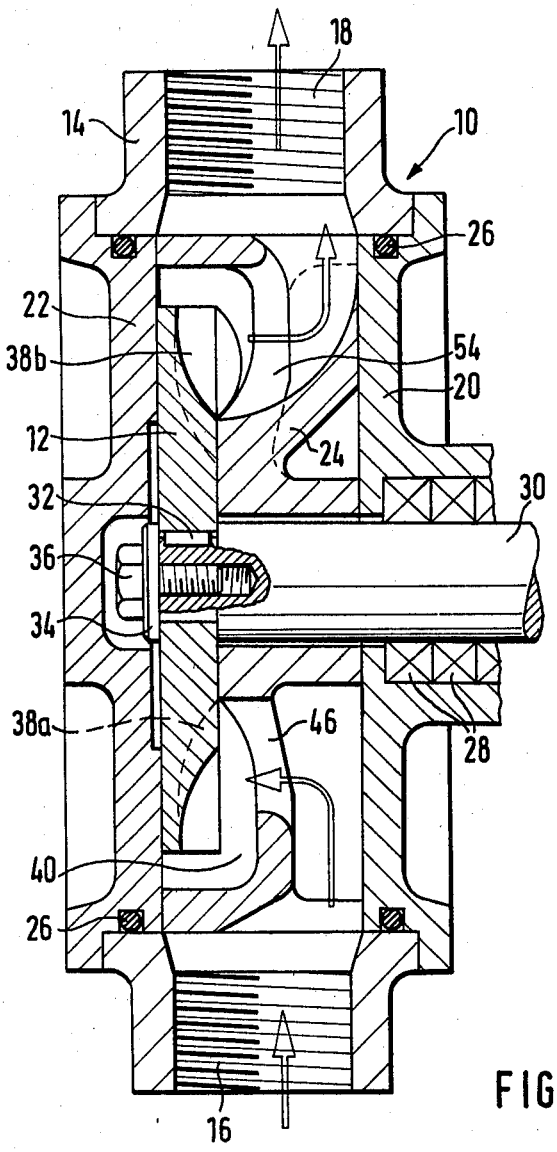
Figure 3:
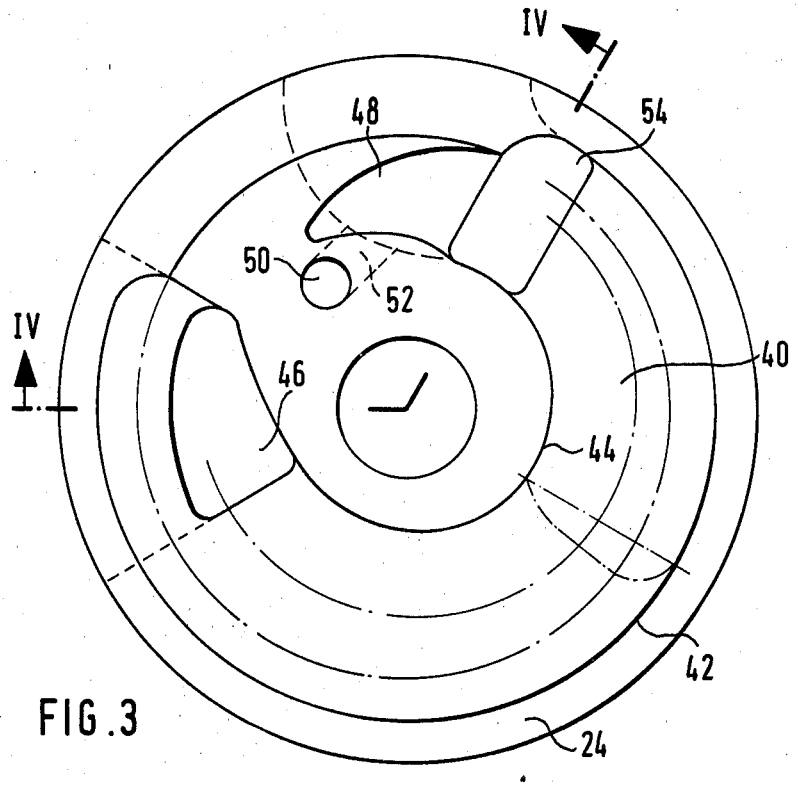
Figure 4:
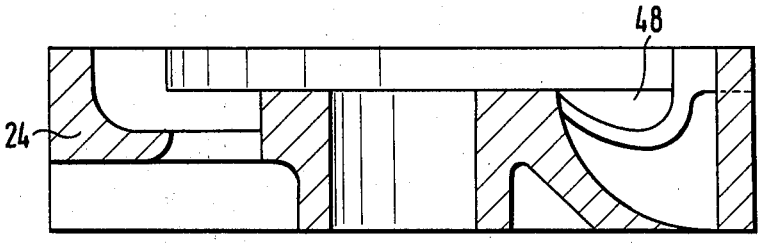
Figure 5:
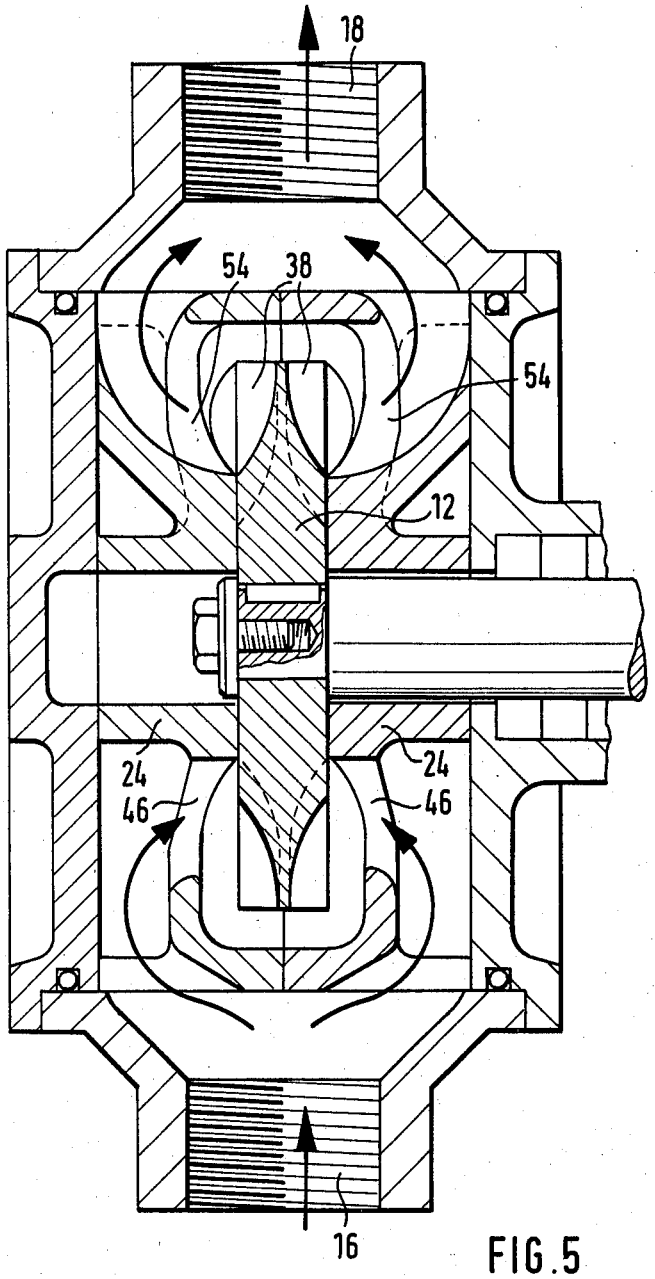
Figure 6:
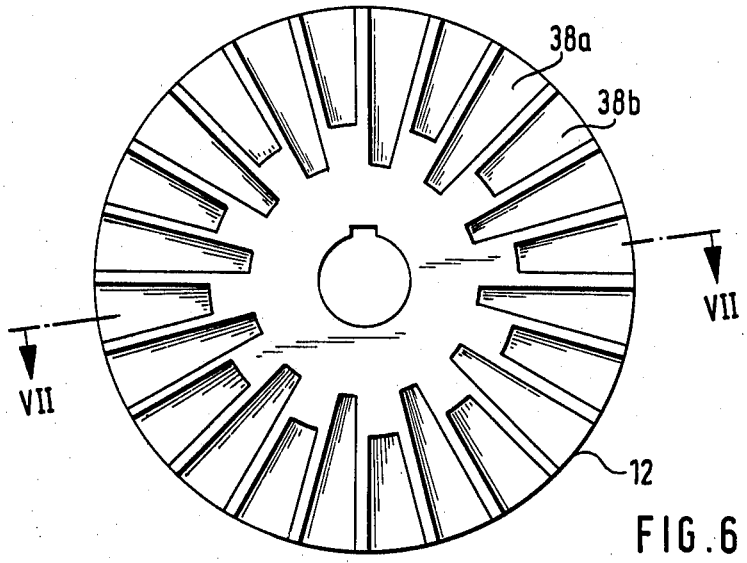
Figure 7:
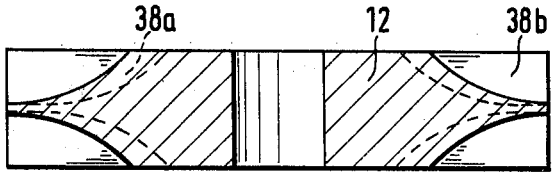
Figure 8:
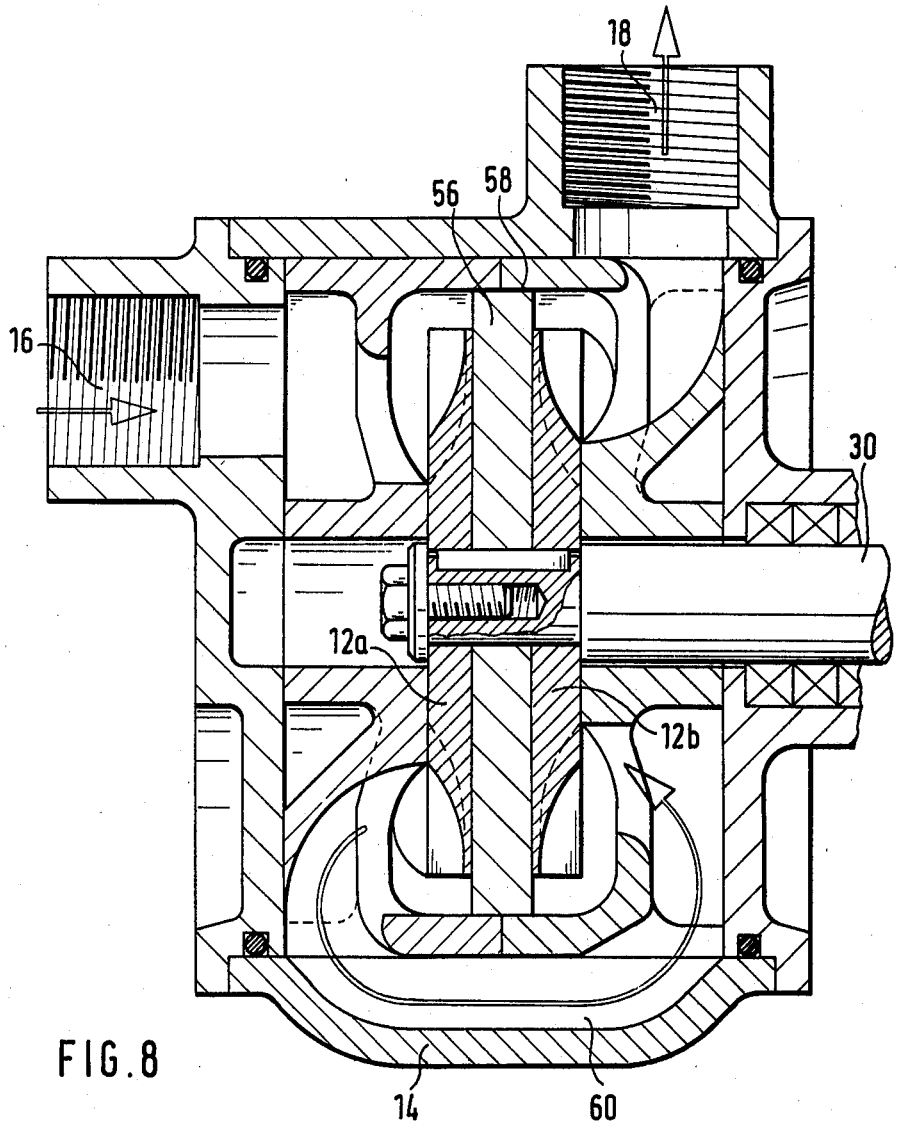
Figure 9:
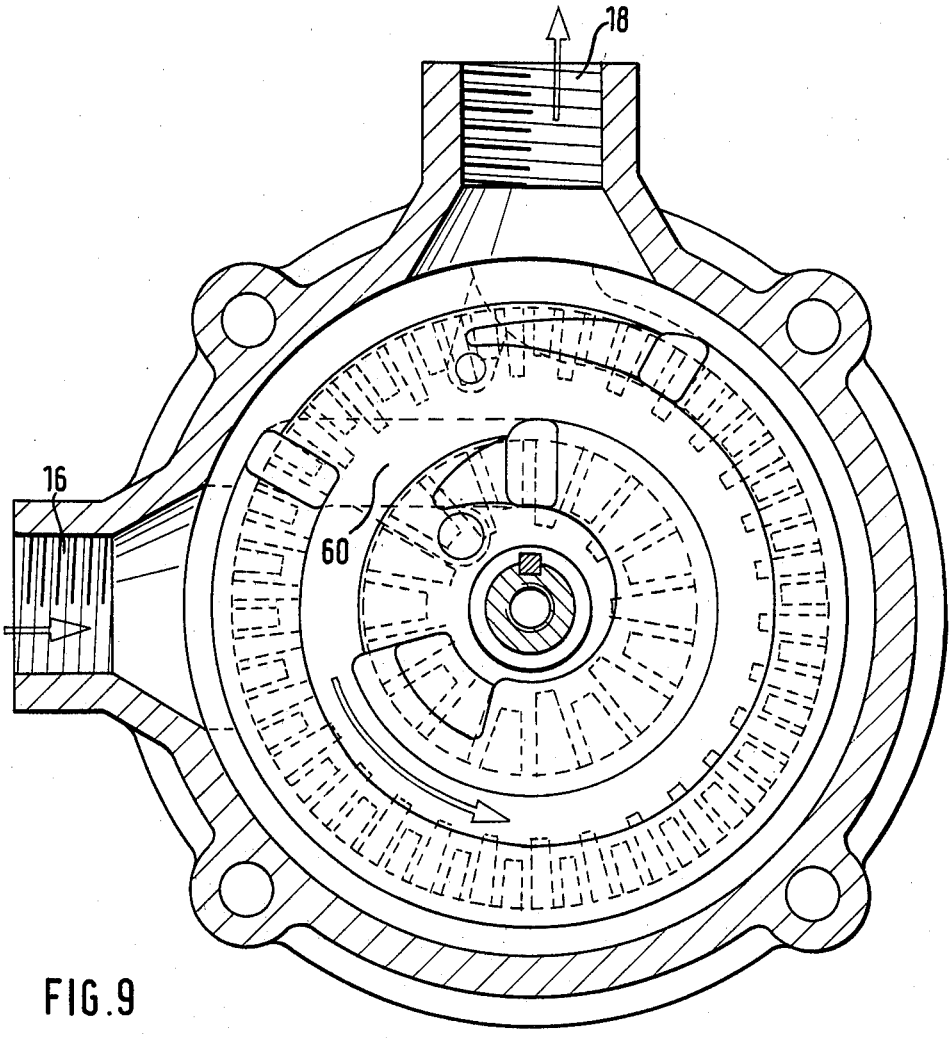
Figure 10:
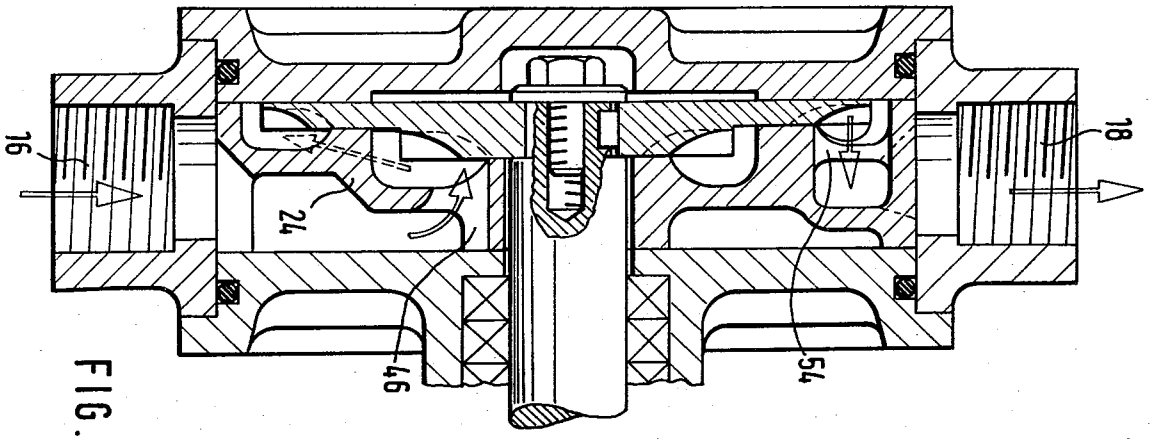
Figure 11:
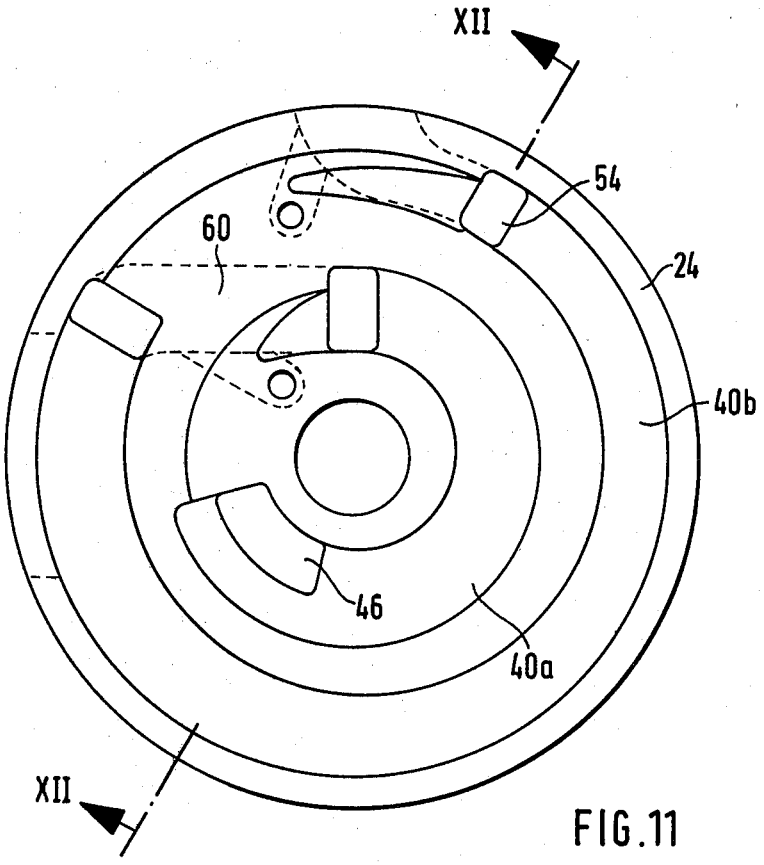
Figure 12:
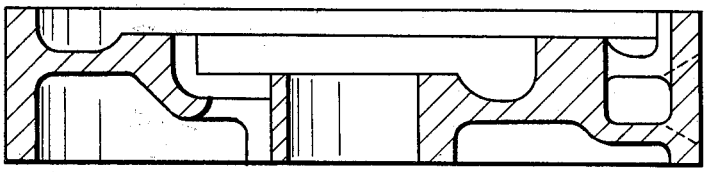
Figure 13:
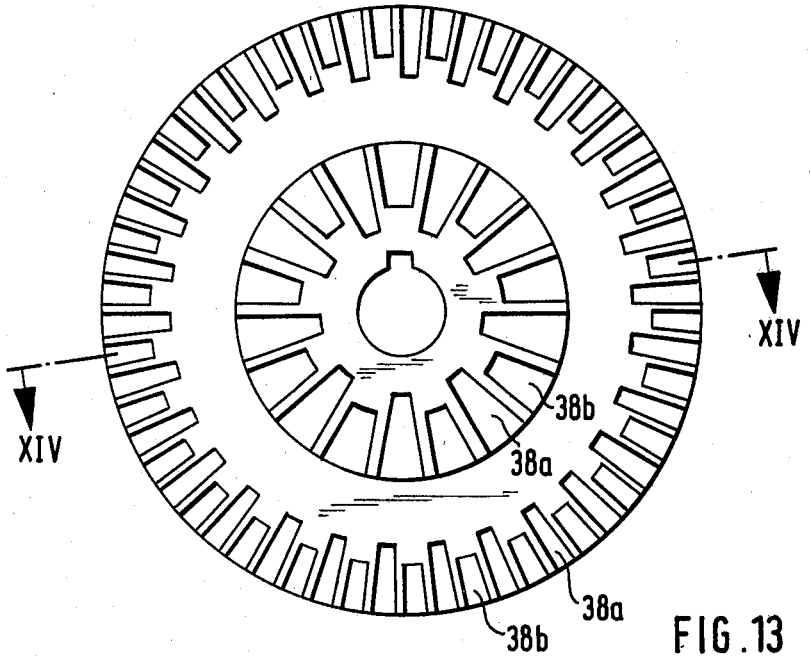
Figure 14:
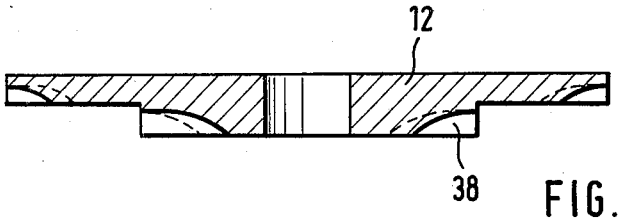
Figure 15:
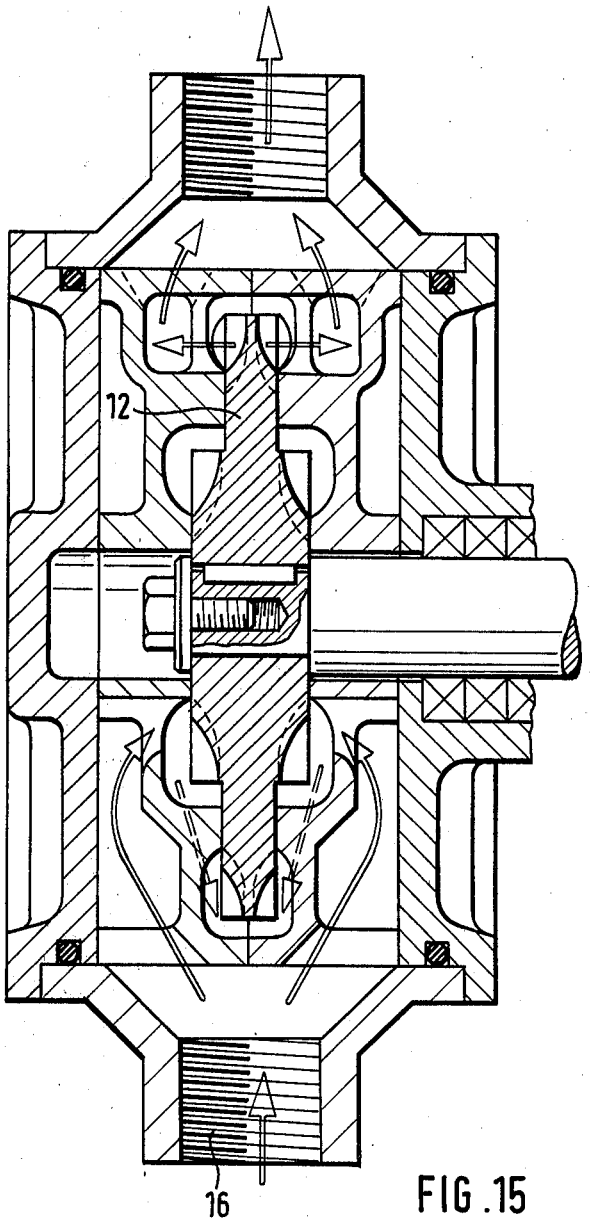
Figure 16:
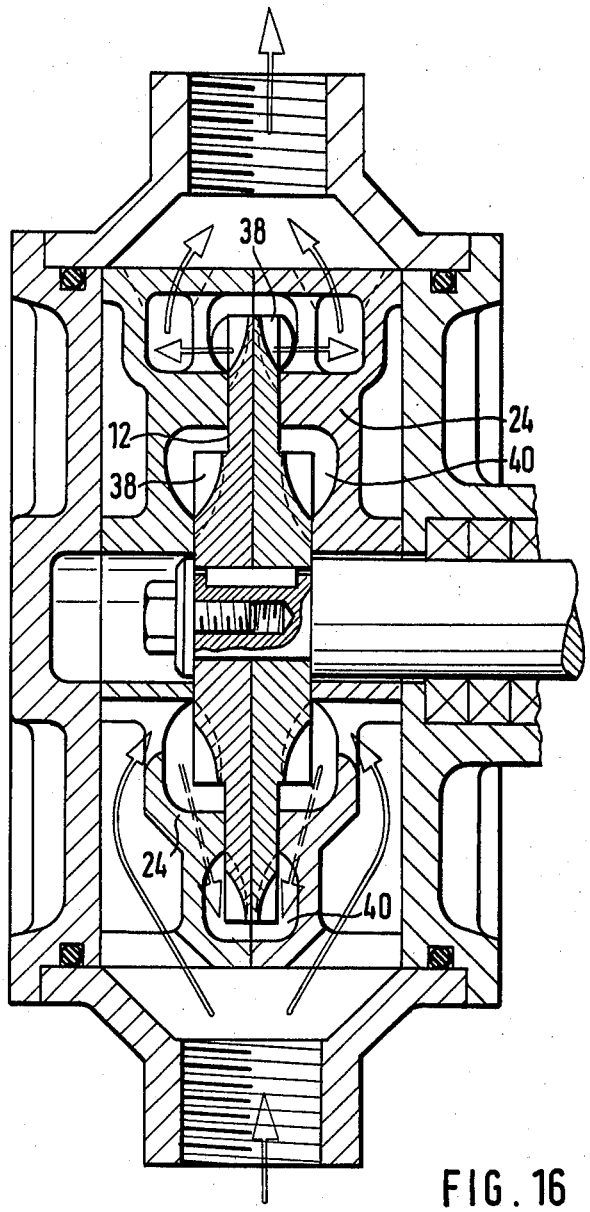
Figure 17:
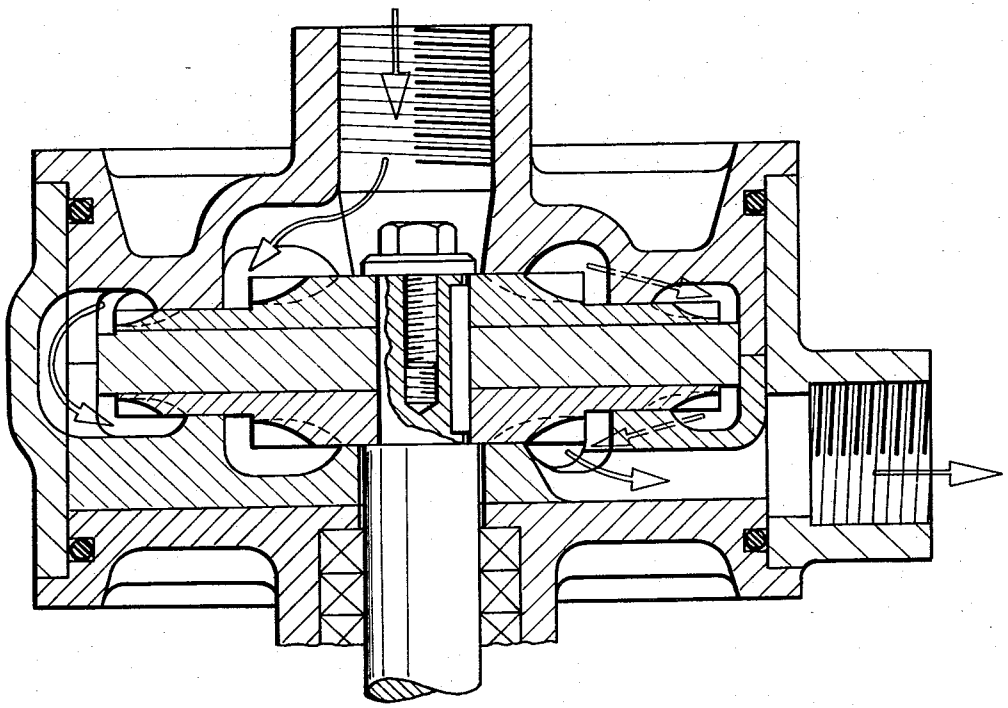
Figure 18:
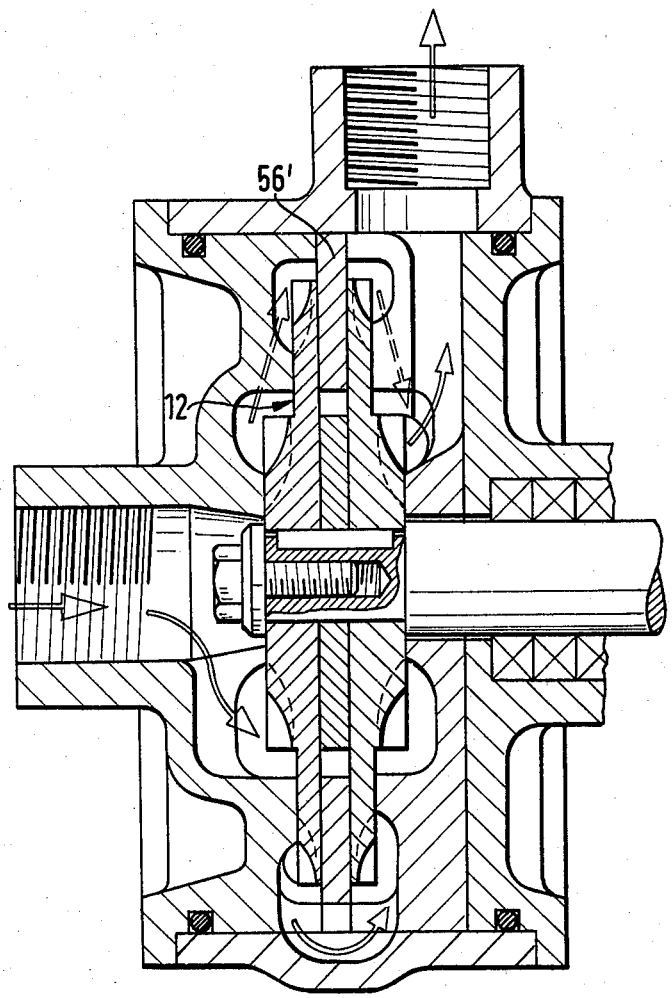
Figure 19:
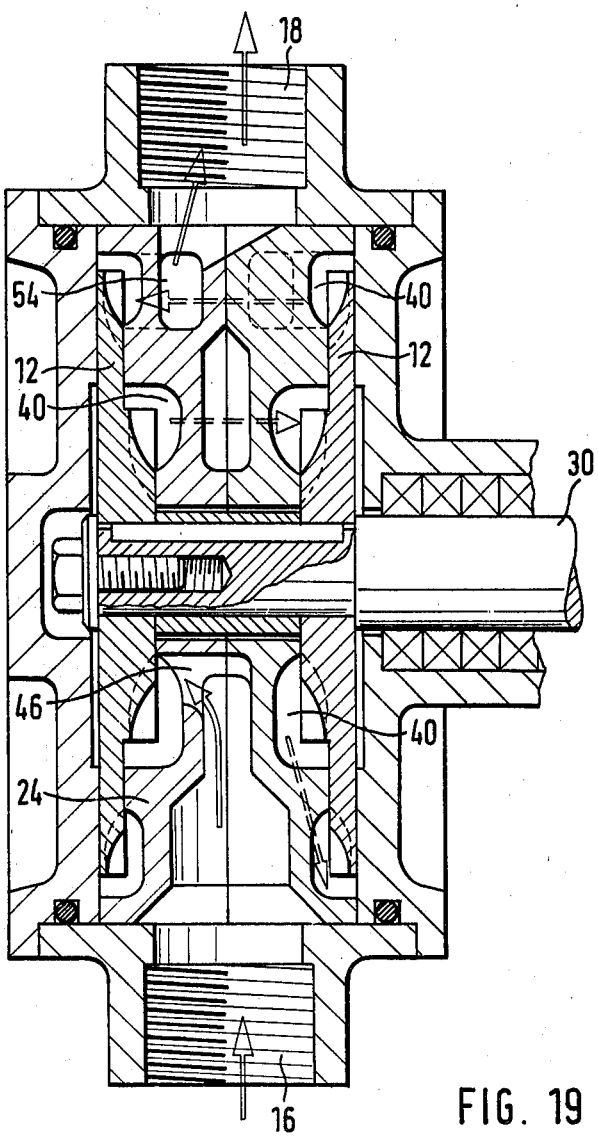
Figure 20:
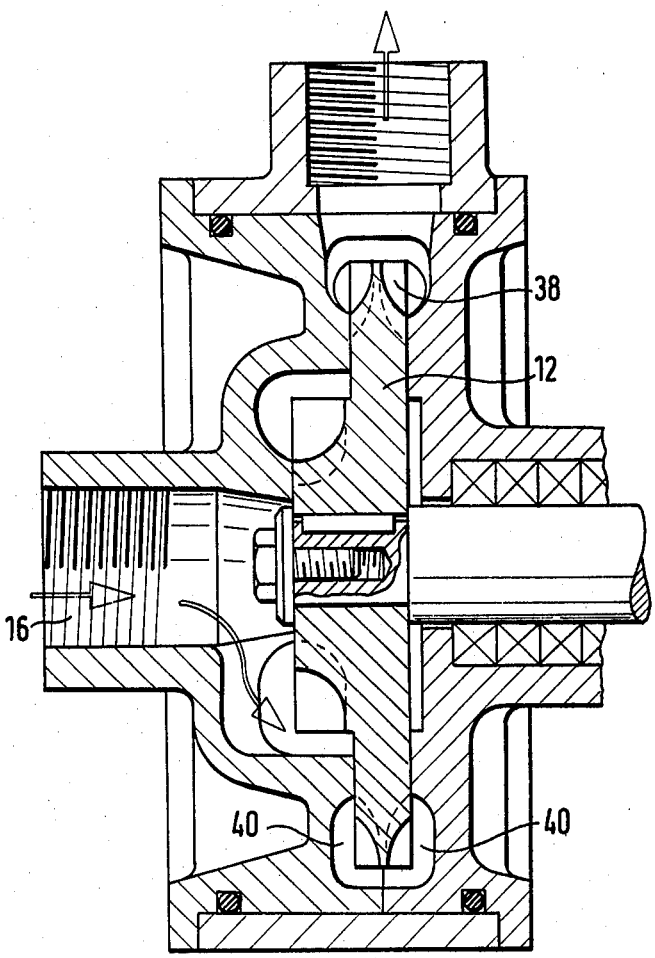

Further features and advantages of the invention will become apparent from the following description of some embodiments by way of example which are shown in the drawings, wherein:

FIG. 1 shows a cross section through a lateral channel pump constructed according to the invention with the rotor shown by broken lines, FIG. 2 is a section in the plane II—II of FIG. 1, FIG. 3 is an elevation of a lateral channel of the pump according to FIGS. 1 and 2, FIG. 4 is a section through the lateral channel in the plane IV—IV of FIG. 3, FIG. 5 is a longitudinal section through a double-flow lateral channel pump constructed according to the invention, FIG. 6 is an elevation of the double-sided rotor of the lateral channel pump according to FIG. 5, FIG. 7 is a longitudinal section in the plane VII—VII of FIG. 6, FIG. 8 is a longitudinal section through another embodiment of the invention, FIG. 9 is a cross section through another alternative embodiment of the invention, FIG. 10 is a longitudinal section through the radially multi-stage lateral channel pump shown in FIG. 9, FIG. 11 is an elevation of the lateral channels of the lateral channel pump according to FIGS. 9 and 10, FIG. 12 is a longitudinal section in the plane XII—XII of FIG. 11, FIG. 13 is an elevation of the radially multi-stage rotor of the lateral channel pump according to FIGS. 9 and 10, FIG. 14 is a longitudinal section in the plane XIV—XIV in FIG. 13, FIG. 15 is a longitudinal section through another alternative embodiment of the invention, FIG. 16 shows a variant of the embodiment shown in FIG. 15, FIG. 17 shows a longitudinal section through another alternative embodiment of the invention, FIG. 18 is a longitudinal section through another embodiment of the invention, FIG. 19 is a longitudinal section through a lateral channel pump with two separate individual discs in the rotor, and FIG. 20 is a longitudinal section through an asymmetrically constructed lateral channel pump according to the invention.

The lateral channel pump shown in FIGS. 1 to 4 is of single-current and single-stage constructions and consists of a housing 10 and a rotor 12. The housing 10 is made up of a housing ring 14 with an intake port 16 and outlet port 18, a bearing cap 20, a housing cover 22 parallel thereto and a housing disc 24 which is secured between the bearing cap 20 and the housing cover 22. The seating of the housing ring 14 on the bearing cap 20 and on the housing cover 22 is outwardly sealed off by means of circular sealing rings 26.

Mounted in the bearing cap 20 of the housing 10 is a shaft 30 sealed off by means of packing rings 28, this shaft being rotatable in the direction of the arrow by means of a drive motor (not shown), for example a bipolar electric motor. The rotor 12 is secured to the free end of the shaft 30 by means of a key and slot arrangement 32 and axial movement is prevented by a disc 34 secured to shaft 30 by means of a screw 36.

The rotor 12, in the form of a disc, is provided with a ring of rotor blade compartments 38 located opposite a lateral channel 40 which is incorporated in the housing disc 24. The rotor blade compartments 38 alternate in length towards the centre of the rotor 12 between a long rotor blade compartment 38*a* and a short rotor blade compartment 38*b*. The lateral channel 40 located opposite has an outer contour 42 which is concentric with the centre of the rotor and an inner contour 44 which tapers helically towards the outlet port 18. Preferably, the inner contour 44 is formed by an Archimedean screw. The spacing of the inner contour 44 from the shaft 30 is such that, as shown in FIG. 2, at the intake port 16, it corresponds to the spacing of a long rotor blade compartment 38*a* and, at the outlet port 18, to the spacing of a short rotor blade compartment 38*b*.

The flow medium entering through the intake port 16 and through an inlet aperture 46 provided in the housing disc 24, and passing into the lateral channel 40 and into the rotor blade compartments 38 of the rotor 12, is accelerated by the centrifugal force of the rotating rotor 12 radially to the periphery, thus forming a spatial circulating current which flows in a helical or spiral motion over the entire length of the lateral channel. A partial circulating current towards the centre of the rotor is superimposed, in bursts, over this circulating current, this partial current being caused by the alternate longer blade compartments 38*a*. This partial circulating current with a higher energy level results in the transmission of energy and an increased circulation speed even within the main circulating current, i.e. it leads to a higher speed of circulation between the lateral channel 40 and the rotor blade compartments 38. This higher speed of circulation results in more frequent re-entry of the flow medium into the rotor blade compartments 38 and thus an increased transmission of energy to the volume current in the lateral channel 40.

With a prototype of a pump constructed according to the invention, the delivery rate was found to be increased by 25%.

As the velocity of the volume current decreases, the pattern of rotation of the main circulating current in the circumferential direction changes from an initial alternating oval shape into a virtually constant, circular shape, i.e. the longer blade compartments 38*a* gradually lose their effect. This requires adaptation to the geometry of the lateral channel, which is achieved according to the invention by the fact that, whilst the side channel 40 has constant plane parallelism and a constant outer contour 42, its inner contour 44 extends helically, so that the longer rotor blade compartments 38*a* are fully effective from the beginning of the lateral channel 40 and are gradually covered up, towards the end of the lateral channel 40, as their action decreases, until the effective length, of the longer compartments, is the same length as the shorter rotor blade compartments 38*b*. Thus, as its amplitude decreases, the partial circulating current gradually merges, with an almost circular pattern of rotation, into the main circulating current which is determined chiefly by the shorter rotor blade compartments 38*b*.

Connected behind the end of the lateral channel 40 is a short, out-going re-displacement channel 48 which tapers axially towards its point. This re-displacement channel 48 speeds up the ventilation process during liquid operation, since the liquid entering can displace the air forced back towards the centre of the rotor into the rotor blade compartments 38, through an adjacent ventilation bore 50 with a ventilation channel 52 connected thereto.

At the compression side, the flow medium leaves the region of the lateral channel through a connected port 54 provided in the housing disc 24 and through the outlet aperture 18.

If the flow medium is a gas, no ventilation bore 50 is required. Then, the flow medium is re-compressed in the re-displacement channel 48, with subsequent pressure relief at the intake end of the lateral channel 40, thus causing more rapid formation of the circulating flow.

FIGS. 5 to 7 show a single-stage double-flow lateral channel pump the rotor 12 of which has rotor blade compartments 38 on both sides. Associated with each of the rings of rotor blades is a lateral channel 40 which is incorporated in a corresponding housing disc 24. The two housing discs 24 make contact with each other in the region of their outer periphery. As shown in FIG. 5, the current of flow medium is divided up behind the intake port 16 and passes through the two entry apertures 46 provided in the housing discs 24, into the flow channel between the lateral channel 40 and the rotor blade compartments 38, from which it re-emerges at the compression end through the connecting openings 54 between the two housing discs 24 and through the outlet port 18.

In the alternative embodiment of a single-current lateral channel pump shown in FIG. 8, the rotor 12 consists of two individual discs 12*a* and 12*b* which are separated from each other by a spacer disc 56. The spacer disc 56 is secured on the shaft 30 together with the two individual discs 12*a* and 12*b* and rotates therewith. Its outer periphery forms a radial sealing surface 58 with the internal diameter of the two housing discs 24. Since the sealing surface 58 is not axially limited, axial displacement of the rotor 12 within the housing disc 24 is possible during assembly of the lateral channel pump without affecting the sealing action. In this way, the lateral channel pump in FIG. 8 has two stages which are separated from each other by the spacing disc 36. The flow medium entering through the intake port 16 flows through the first stage and then into the second stage through a transfer channel 60 incorporated in the housing ring 14 and, after barely one rotation, it leaves the lateral channel 40 of the second stage through the outlet port 18. In this arrangement, the flow medium flows through the pump in one current into 2 stages arranged axially in series.

FIGS. 9 and 10 show a single-flow, two-stage lateral channel pump in which the two stages are arranged radially in series. The flow medium flows through the intake port 16 through the inlet aperture 46 provided in the housing disc 24 and into the first stage which is the radially inner stage, and from there through a transfer channel 60 which is shown by broken lines in FIG. 9, in the rear part of the housing disc 24, into the second stage which is radially outward from the inlet aperture 46. On leaving the second stage, the flow medium flows through a connecting port 54 which is also provided in the rear part of the housing disc 24 and outwards through the outlet port 18. The fact that the connecting port 54 is provided axially behind the lateral channel 40 is advantageous since this restricts the radial dimensions of the lateral channel pump. Another advantage of the release of flow medium through the connecting port 54 in the axial direction is that no operating fluid is lost, as would be the case with radial release.

FIGS. 11 and 12 show a view of the two lateral channels 40*a* and 40*b* provided in the housing disc 24. FIGS. 13 and 14 show the rotor 12 which conveys the medium radially in two stages, the two rings of rotor blades being provided with alternately long blade compartments 38*a* and short blade compartments 38*b*, according to the invention.

FIG. 15 shows a double-flow lateral channel pump constructed in two stages. The flow channel of the flow medium is divided up behind the intake port 16 and then flows first into the first stage which is radially on the inside, and from there into the second stage which is the radially outer stage. The rotor 12, which is provided with rings of rotor blades on both sides, is constructed in one piece.

In the alternative embodiment of the double-flow, two-stage lateral channel pump of FIG. 15 which is shown in FIG. 16, the rotor 12 is made up of two individual discs placed back to back. Here, again, each individual disc of the rotor 12 has two concentric rings of blades of different diameters. Each ring of blades is again associated with a lateral channel 40 which is provided in the corresponding stage of the housing disc 24. Since the throughput through the pump is constant, the volume of the outer rotor blade compartments 38 is smaller than that of the inner rotor blade compartments 38, as in the embodiment of FIG. 9.

As a result of the mirror-symmetrical construction of the rotor 12, which can be operated in both directions of rotation, the axial stresses cancel each other out during operation, thus establishing a floating, axially balanced mounting for the rotor 12. The rotor 12 can be adjusted so as not to make contact with the two housing discs 24, thus avoiding any friction and resultant wear between the rotor 12 and housing disc 24, which in turn is favourable with respect to the service life of the pump and the noise produced during operation.

FIG. 17 shows a single-flow, four-stage lateral channel pump the rotor 12 of which is also made up of two individual discs separated from each other by a spacer disc 56. The construction, of the rotor, is thus essentially that of the pump shown in FIG. 8. The four stages are connected in series so that, with the same geometric arrangement as in the pump shown in FIGS. 15 and 16, the throughput is only half as much and the feed pressure is twice as great.

FIG. 18 shows an alternative embodiment of the single-flow, four-stage pump of FIG. 17, but with the seal between the two individual discs of the rotor 12 being provided at the outer periphery by means of a spacer disc 56' time clamped between the housing sections. As a result, four radial sealing surfaces with an axial sealing action are produced between the spacer disc 56' and the individual discs of the rotor 12.

FIG. 19 also shows a four-stage version of the lateral channel pump wherein the rotor 12 again consists of two individual discs but these discs are secured to the shaft 30 with their rings of rotor blades facing each other, while the part of the housing which contains the lateral channel 40 projects into the space between the two individual discs 12. From the intake port 16, the flow channel passes via the entry aperture 46 in the left-hand housing disc 24 into the first stage, which is the radially inner stage, and from there, after barely one revolution, through an axial passage into the radially identical stage of a first section of the lateral channel 40. After another scant revolution, the flow medium passes, via a tangential transfer channel, into the radially outer stage on the same side and from there, after another scant revolution, through an axial passage into the axially adjacent, radially identical second section of the channel 40, from which it finally passes through the connecting port 54 into the outlet port 18.

Finally, FIG. 20 shows an embodiment of a lateral channel pump according to the invention with an axially central intake port 16 and a rotor 12 of assymetric construction. The flow medium is taken in, in a single flow, by the stage which is smallest in diameter and, after one scant revolution, it is passed to the double-flow second stage, which consists of two rings of rotor blade compartments 38 arranged back to back on the rotor 12, which is formed in one piece, whilst two lateral channels 40 are located opposite these two rings of rotor blade compartments 38, at the same radial height.

I claim:

1. A lateral channel pump, comprising a housing provided with intake and outlet ports, a shaft extending into said housing, seal means sealingly engaged between said shaft and said housing, a rotor secured to said shaft, and a flow channel which starts from said intake port in said housing and leads to said outlet port in said housing through at least one lateral channel and also through blade compartments of said rotor, characterized in that the blade compartments are defined by a ring of blades of said rotor which alternate in length, towards the center of the rotor, between a long blade compartment and a short blade compartment, the lateral channel has a constant outer contour concentric with the center of the rotor and an inner contour tapering helically towards said outlet port, the spacing of the inner contour relative to said shaft at said intake port corresponds to the spacing of the long rotor blade compartment relative to the shaft and, at the outlet port, the spacing of the inner contour corresponds to the spacing of a short rotor blade compartment relative to the shaft.

2. A lateral channel pump according to claim 1, characterised in that the inner contour tapers in the manner of an Archimedean screw.

3. A lateral channel pump according to claim 1 or 2, characterised in that the rotor has rings of rotor blade compartments arranged on both sides, separated by a central web and each ring has a lateral channel located opposite.

4. A lateral channel pump according to claim 3, characterised in that the rotor which is asymmetric in cross section and has only one ring of blades at the intake end and, at the compression end, has a double-sided set of rings of blades which are associated with correspondingly formed lateral channels in the housing.

5. A lateral channel pump according to claim 1 or 2, characterised in that the rotor consists of two individual discs which are mounted in mirror-symmetry on the shaft, and which both have rings of rotor blade compartments.

6. A lateral channel pump according to claim 5, characterised in that the two individual discs of the rotor are separated from each other by a spacer disc which divides the flow channel into two stages arranged in series.

7. A lateral channel pump according to claim 5, characterised in that the two individual discs of the rotor are secured to the shaft with their rings of blades facing each other, and in that the part of the housing which contains the lateral channels projects into the space between the two individual discs.

8. A lateral channel pump according to claim 1, characterized in that the rotor has a plurality of rings of rotor blade compartments of different diameters, arranged in series in the radial direction, each being associated with said lateral channel in the housing, a first section of said channel in fluid communication with a second section of said channel, said second section of said channel extending in the opposite lateral direction to said first section of said channel.

* * * * *

UNITED STATES PATENT AND TRADEMARK OFFICE

CERTIFICATE OF CORRECTION

PATENT NO. : 4,408,952

DATED : October 11, 1983

INVENTOR(S) : Friedrich SCHWEINFURTER

It is certified that error appears in the above—identified patent and that said Letters Patent is hereby corrected as shown below:

On the face of the patent, the Foreign Application Priority Data should read as follows:

--Apr. 15, 1980 [DE] Fed. Rep. of Germany ..... 3014425—.

Signed and Sealed this

*Eighth* Day of *October 1985*

[SEAL]

*Attest:*

DONALD J. QUIGG

*Attesting Officer*

*Commissioner of Patents and Trademarks—Designate*